US011126141B2

(12) United States Patent
Lagorgette

(10) Patent No.: US 11,126,141 B2
(45) Date of Patent: Sep. 21, 2021

(54) DEVICE FOR SELECTION OF A COMBINATION OF MOTIFS, AND TIMEPIECE COMPRISING A DEVICE OF THIS TYPE

(71) Applicant: ETA SA Manufacture Horlogere Suisse, Grenchen (CH)

(72) Inventor: Pascal Lagorgette, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 412 days.

(21) Appl. No.: 16/169,396

(22) Filed: Oct. 24, 2018

(65) Prior Publication Data

US 2019/0146412 A1 May 16, 2019

(30) Foreign Application Priority Data

Nov. 16, 2017 (EP) ..... 17202161

(51) Int. Cl.
*G04B 19/253* (2006.01)
*G04B 19/04* (2006.01)
(Continued)

(52) U.S. Cl.
CPC ..... *G04B 19/25333* (2013.01); *G04B 19/046* (2013.01); *G04B 19/202* (2013.01); *G04C 17/005* (2013.01)

(58) Field of Classification Search
CPC ..... G04B 19/25333; G04B 19/046; G04B 19/202; G04B 19/24; G04B 19/247; G04C 17/005; G04C 17/0066
(Continued)

(56) References Cited

U.S. PATENT DOCUMENTS 4,257,113 A * 3/1981 Meister ..... G04C 17/0066 368/188
2002/0159337 A1* 10/2002 Weissbach ..... G04B 19/2536 368/37
(Continued)

FOREIGN PATENT DOCUMENTS

CH 190208 4/1937
EP 1 526 415 A1 4/2005
(Continued)

OTHER PUBLICATIONS

European Search Report dated Jun. 6, 2018 in European Application 17202161.0 filed on Nov. 16, 2017 (with English Translation of Categories of Cited Documents).
(Continued)

*Primary Examiner* — Edwin A. Leon
(74) *Attorney, Agent, or Firm* — Oblon, McClelland, Maier & Neustadt, L.L.P.

(57) ABSTRACT

A device for selection of a combination of motifs for a timepiece, including an inner disc, and a coaxial outer disc, the inner disc having a smaller diameter than the outer disc, the discs including angular sectors of the same size, at least two angular sectors of each disc bearing a motif on their periphery; a device for actuation permitting rotation of the inner disc, and a gear device for coupling the two discs according to a reduction ratio; a dial extending opposite the inner disc, the dial including an aperture to put a motif of the inner disc and a motif of the outer disc into correspondence, such that a complete rotation of the inner disc gives rise to a rotation of the outer disc by one angular sector, the size of the aperture being sufficiently large for each motif of the outer disc to be in correspondence successively with all the motifs of the inner disc, when the inner disc is rotated.

12 Claims, 2 Drawing Sheets

(51) Int. Cl.
*G04B 19/20* (2006.01)
*G04C 17/00* (2006.01)

(58) Field of Classification Search
USPC ..... 368/37
See application file for complete search history.

(56) References Cited

U.S. PATENT DOCUMENTS

| | | | | |
|---|---|---|---|---|
| 2003/0103417 | A1* | 6/2003 | Gabathuler ..... | G04B 19/2536 368/37 |
| 2005/0088917 | A1 | 4/2005 | Dalloz | |
| 2008/0279049 | A1* | 11/2008 | Schmiedchen .. | G04B 19/25386 368/37 |
| 2014/0301170 | A1 | 10/2014 | Tran et al. | |

FOREIGN PATENT DOCUMENTS

| | | | |
|---|---|---|---|
| JP | 55-138677 | A | 10/1980 |
| JP | 11- 66982 | A | 6/1999 |
| JP | 5517004 | B2 | 6/2014 |
| WO | WO 2012/127055 | A1 | 9/2012 |

OTHER PUBLICATIONS

Japanese Office Action dated Jun. 30, 2020 in Japanese Application 2018-212730 (with English Translation), citing documents AO-AP therein, 11 pages.
Korean Office Action dated Sep. 1, 2020 in Korean Application 10-2018-0137084 (with English Translation), citing documents AB & AQ therein, 8 pages.
Korean Office Action dated Apr. 28, 2021 in Korean Patent Application No. 10-2020-0128308 (with English translation), 10 pages.
Korean Office Action dated Mar. 2, 2021 in Korean Patent Application No. 10-2018-0137084, 7 pages.
The Third Office Action dated Jul. 1, 2021 in corresponding Chinese Patent Application No. 201811358855.6 (with English translation)(15 pages).

* cited by examiner

DEVICE FOR SELECTION OF A COMBINATION OF MOTIFS, AND TIMEPIECE COMPRISING A DEVICE OF THIS TYPE

CROSS-REFERENCE TO RELATED APPLICATION

This application claims priority to European Patent Application No. 17202161.0 filed on Nov. 16, 2017, the entire disclosure of which is hereby incorporated herein by reference.

FIELD OF THE INVENTION

The invention relates to the field of devices for selection of functions represented by motifs, for example logos. A device of this type can be integrated in a timepiece of the wristwatch type, and can be used for example within the context of bank payments.

BACKGROUND OF THE INVENTION

Payment watches have recently appeared on the market, starting a new era for credit payments, and making payment for small purchases faster and more convenient than searching in one's pockets, looking for change. A watch of this type is conventionally provided with a device for selection of a combination of payment options, each option being represented for example by a motif (or logo). It is thus for example possible to select and display a type of bank card (Visa, MasterCard, etc.), a type of bank account (account for household expenses, account for personal expenses, etc.), etc.

For aesthetic reasons and/or for the sake of economy, it is desirable to avoid using a screen. In fact, liquid crystal (LCD) screens have a limited aesthetic appeal, whereas organic light-emitting diode (OLED) screens or screens with similar technology are costly and consume a lot of energy. In addition, a screen has an overall aesthetic impact on a watch, giving it a less timepiece-like appearance, which can be displeasing.

SUMMARY OF THE INVENTION

The objective of the present invention is thus to propose a device for selection of motifs which does not comprise a display screen, and is simple and inexpensive to produce.

According to a first aspect, the invention relates to a device for selection of a combination of motifs, in particular for a timepiece, comprising:

- A first disc, known as the inner disc, and a second disc, known as the outer disc, which are coaxial, the inner disc having a smaller diameter than the outer disc, the discs comprising a plurality of angular sectors of the same size, at least two angular sectors of each disc bearing a motif on their periphery;
- Means for actuation permitting rotation of the inner disc, and gear means coupling the two discs according to a reduction ratio;
- A dial extending opposite the inner disc, the dial comprising an aperture making it possible to put a motif of the inner disc and a motif of the outer disc into correspondence.

The device is such that a complete rotation of the inner disc gives rise to a rotation of the outer disc by one angular sector, the size of the aperture being sufficiently large for each motif of the outer disc to be in correspondence successively with all the motifs of the inner disc, when the inner disc is rotated.

The device according to the invention is a coaxial counter with two discs, inspired by the operating principle of an hours and minutes counter. The outer disc rotates more slowly than the inner disc, and can be assimilated to an hours wheel. The inner disc, for its part, can be assimilated to a minutes wheel. However, it can be noted that the reduction of ratio between the inner disc and the outer disc is not necessarily 12, as is the case for a conventional hours/minutes counter. The reduction of ratio depends on the number of motifs on the discs and on the location of these motifs. A reduction ratio with the value M means that a rotation of 360° of the drive disc (in this case the inner disc) gives rise to a rotation of 360/M° of the driven disc (in this case the outer disc).

In the same way as for an hours/minutes counter, a complete rotation of the inner disc gives rise to rotation of an angular sector of the outer disc. In order to make the outer disc advance by one step without changing the angular sector of the inner disc which is in the aperture (so as to modify information, i.e. a motif or optionally a space without motif (a so-called empty space) given by the outer disc through the aperture, without changing the information given through the aperture by the inner disc), it is thus sufficient to impose a rotation of 360° on the inner disc. On the other hand, each rotation of an angular sector of the inner disc makes the outer disc advance by a fraction of the angular sector which depends on the reduction ratio, the reduction ratio itself depending on the number of angular sectors of the outer disc. In order to modify the information given through the aperture by the inner disc, without changing the information given through the aperture by the outer disc, it is therefore necessary for the aperture to be large enough for all the motifs borne by the inner disc to be able to pass successively through the aperture without affecting the information displayed via the outer disc. "Passing of the motifs of the inner disc" means a successive, and single, passage of the motifs of the inner disc into the aperture. Passage of the motifs of the inner disc is therefore not necessarily equivalent to a complete turn of the inner disc.

It will be noted that it could be envisaged for the ratio between the drive disc (the inner disc) and the driven disc (the outer disc) to be a multiplication ratio instead of a reduction ratio. In this case the drive disc (the inner disc) would rotate more slowly than the driven disc (the outer disc).

According to a second aspect, the invention relates to a device for selection of a combination of motifs, in particular for a timepiece, comprising:

- A first disc, known as the inner disc, and a second disc, known as the outer disc, which are coaxial, the inner disc having a smaller diameter than the outer disc, the discs comprising a plurality of angular sectors of the same size, at least two angular sectors of each disc bearing a motif on their periphery;
- Means for actuation permitting rotation of the outer disc, and gear means coupling the two discs according to a multiplication ratio;
- A dial extending opposite the inner disc, the dial comprising an aperture making it possible to put a motif of the inner disc and a motif of the outer disc into correspondence.

The device is such that a rotation of the outer disc by one angular sector gives rise to a complete rotation of the inner disc, the size of the aperture being sufficiently large for each motif of the outer disc to be in correspondence successively with all the motifs of the inner disc, when the outer disc is rotated.

The difference according to the invention, compared with the first aspect, is that the drive disc is the outer disc, and the driven disc is the inner disc. It will be noted that it could be envisaged for the ratio between the drive disc (the outer disc) and the driven disc (the inner disc) to be a reduction ratio instead of a multiplication ratio. In this case the drive disc (the outer disc) would rotate more slowly than the driven disc (the inner disc).

In the selection devices according to the first aspect or the second aspect, the means for actuation and the gear means make it possible to rotate the inner and outer discs together. The means for actuation are for example actuated by an electric motor. This therefore avoids having to resort to a plurality of motors in order to rotate the outer and inner discs separately. By means of the invention, a saving in space and weight is obtained by reducing the number of motors required to make the display device operate. These savings are particularly advantageous for a timepiece.

The device according to the first aspect or the second aspect can comprise the following additional characteristics, taken alone or according to all the combinations which are technically possible.

Advantageously, each angular sector of the outer disc bearing a motif is preceded and followed by an angular sector bearing a space without a motif.

As previously explained, thanks to an appropriate size of the aperture, all the motifs which are borne by the inner disc can pass successively into the aperture without modifying the information (a motif or optionally a space) provided by the cooperation of the aperture and the outer disc. It will be understood that, during a passage of the motifs of the inner disc, a motif of the outer disc which is displayed in the aperture does not remain centred in the said aperture: it is displaced between a first end and a second end of the aperture. Surrounding with spaces both sides of each motif borne by the outer disc prevents a portion of another motif of the outer disc from appearing in the aperture during a passage of the motifs of the inner disc. The motifs which are borne by the outer disc can also have the largest size possible, which assists their legibility.

Advantageously, one angular sector out of two of the outer disc bears a motif.

Thanks to this characteristic, the outer disc bears the largest possible number of motifs.

According to an embodiment of the first aspect or the second aspect, the inner disc bears at the most four motifs, and advantageously two or three.

In fact, the larger the number of motifs borne by the inner disc, the larger the size of the aperture must be. Limiting the number of motifs to four, or to two or three, thus makes it possible to limit the size of the aperture.

According to an embodiment of the first aspect or the second aspect, at least one angular sector of the inner disc bears a space without a motif.

Thanks to this characteristic, when the motifs of the inner disc have passed once through the aperture, at least one empty space (without a motif) is displayed in the aperture before the first motif of the inner disc is displayed once more. This prevents, in at least one position, a motif of the inner disc from being in correspondence with two portions of different motifs of the outer disc.

According to an embodiment of the first aspect or the second aspect, the motifs of the inner disc are disposed on consecutive angular sectors, a first motif and a final motif of the inner disc being separated by at least one angular sector bearing a space without a motif.

This characteristic makes it possible to prevent a motif of the inner disc and two portions of motifs of the outer disc from being in the aperture simultaneously.

The device according to the first aspect or the second aspect comprises a single motor in order to actuate the inner and outer discs together via the gear means and the means for actuation.

The invention also relates to a timepiece, in particular a payment watch, comprising a device of this type for selection of motifs.

BRIEF DESCRIPTION OF THE DRAWINGS

Other particular features and advantages will become clearly apparent from the description provided hereinafter, which is by way of indication and is in no way limiting, with reference to the appended drawings in which.

DETAILED DESCRIPTION OF THE PREFERRED EMBODIMENTS

Figure 1:
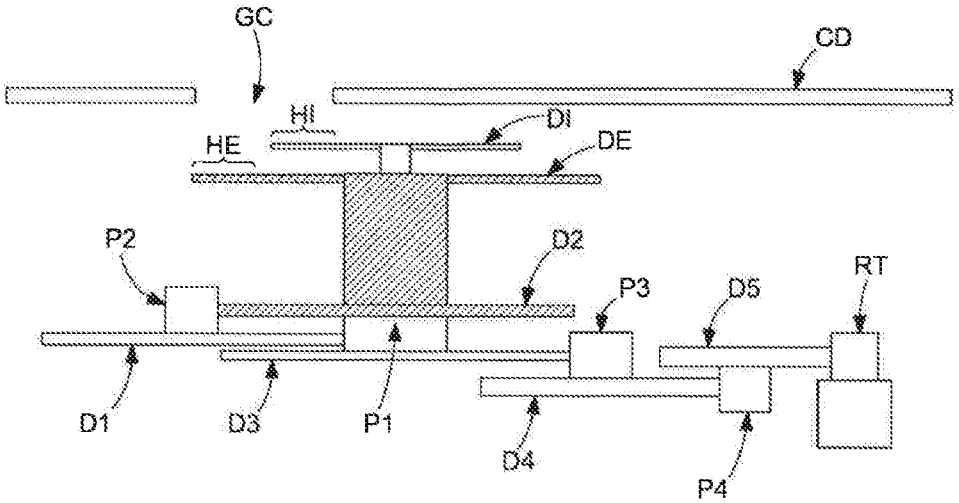
FIG. 1 is a side view of the device for selection of a combination of motifs according to the first aspect of the invention.

FIG. 1 shows a device for selection of motifs, in particular for a timepiece, according to a first aspect of the invention. The device comprises:

- a first disc, known as the inner disc DI;
- a second disc, known as the outer disc DE, which is coaxial to the inner disc DI and has a diameter larger than the inner disc DI;
- a dial CD comprising an aperture GC, i.e. a through opening, the dial CD being disposed such that the inner disc DI is between the dial CD and the outer disc DE.

Since the outer disc DE has a diameter larger than the inner disc DI, an annular peripheral portion HE of the outer disc DE is opposite the dial CD. On this portion, motifs are represented. Similarly, on an annular peripheral portion HI of the inner disc DI, motifs are represented.

More specifically, the peripheral portions of the discs DI, DE comprise a plurality of angular sectors with the same size, and at least two angular sectors of each disc bear a motif. The term "symbol" will be used for a motif or for a space without motif (also known as a space Ø). Each angular sector thus bears a symbol. The aperture GC is arranged such as to be opposite a symbol of the inner disc DI and a symbol of the outer disc DE in order to put them into correspondence. Through the aperture GC, it is thus possible to see a combination of two symbols.

The device also comprises:

- means for actuation of the inner disc DI making it possible to rotate the inner disc DI by a required angle. These means can for example be an assembly comprising for example a rod which can be actuated (not represented), a disc D1 being able to be driven by the rod, and a pinion P1 which engages with the disc D1 and is integral in rotation with the inner disc DI;

gear means between the inner disc DI and the outer disc DE, in order to impose a reduction ratio between the inner (drive) disc DI and the outer (driven) disc DE. These means are for example an assembly comprising the pinion P1, the disc D1, a pinion P2 which is integral in rotation with the disc D1, and a disc D2 which engages with the pinion P2 and is integral in rotation with the outer disc DE.

In addition, the inner disc DI of the selection device is connected, via a chain comprising discs and pinions, to a rotor RT of an electric motor. The chain comprises for example a disc D3 which is integral in rotation with the inner disc DI, a pinion P3 which engages with the disc D3, a disc D4 which is integral in rotation with the pinion P3, a pinion P4 which engages with the disc D4, and a disc D5 which is integral in rotation with the pinion P4. The motor thus makes it possible to rotate the inner and outer discs together. A single motor is sufficient to actuate the two discs.

According to the invention, a complete rotation of the inner disc DI gives rise to a rotation of the outer disc DE by one angular sector. In addition, the size of the aperture GC is sufficiently large for each motif of the outer disc DE to be successively in correspondence with all the motifs of the inner disc DI when the inner disc DI is put into rotation.

By way of example, FIGS. 2*a* to 2*e* show an embodiment in which the inner disc DI comprises four angular sectors, three of which bear motifs A, B, C, and one of which bears an empty space Ø. The outer disc comprises eight angular sectors, three of which bear motifs D, E, F, and five of which bear empty spaces Ø. In an initial position, the combination A D is displayed in the aperture GC. As the inner disc DI rotates, the following combinations are displayed:

B D (FIG. 2*b*)—C D (FIG. 2*c*)—Ø D//E (FIG. 2*d*)—A E (FIG. 2*e*), etc.

D//E means that the aperture GC is facing half of the motif D and half of the motif E. It can thus be noted that a complete rotation of the inner disc DI has made the outer disc DE advance by one angular sector. It can also be noted that the aperture GC is sufficiently large for the symbol D to have been successively in correspondence with the motifs A, B and C during the rotation of the inner disc DI.

Figure 2A:
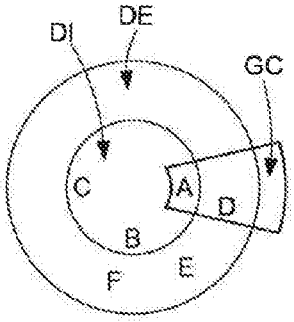
FIGS. 2*a* to 2*e* are views from above of the discs and of the aperture of the device in FIG. 1, representing successive positions of the discs during a complete rotation of the inner disc.
Figure 2B:
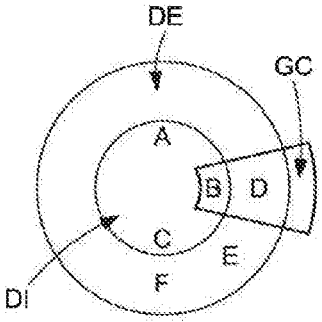
Figure 2C:
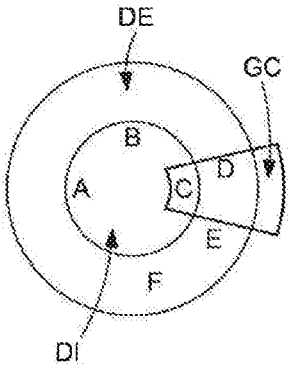
Figure 2D:
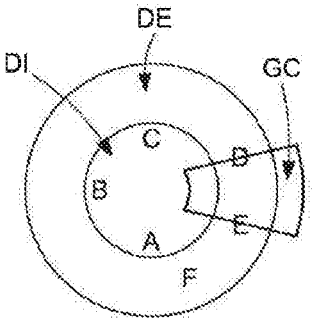
Figure 2E:
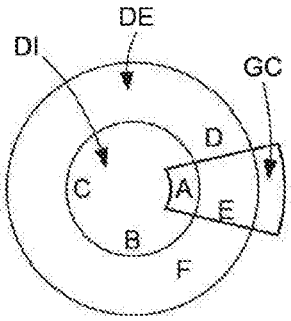

It is noted that the fact of having left an angular sector empty between the angular sectors of the disc bearing the motifs A, B, C has made it possible, in FIG. 2*d*, to prevent a motif of the inner disc from facing halves of motifs D//E of the outer disc.

Advantageously, each motif of the outer disc DE is preceded and followed by a space. In other words, the angular sectors which surround both sides of an angular sector bearing a motif bear empty spaces. A configuration of this type would have prevented a portion of the motif D and a portion of the motif E from being simultaneously in the aperture GC in FIG. 2*d*.

Advantageously, one angular sector out of two of the outer disc bears a motif, in order to maximise the number of possible combinations which can be selected via the device.

Advantageously, the inner disc bears at the most four motifs, advantageously two or three. In fact, it is understood that, for a given number of motifs on the outer disc, the more motifs the inner disc comprises, the larger the aperture must be in order for each motif of the outer disc to be able to be successively in correspondence with each of the motifs of the inner disc.

Figure 3:
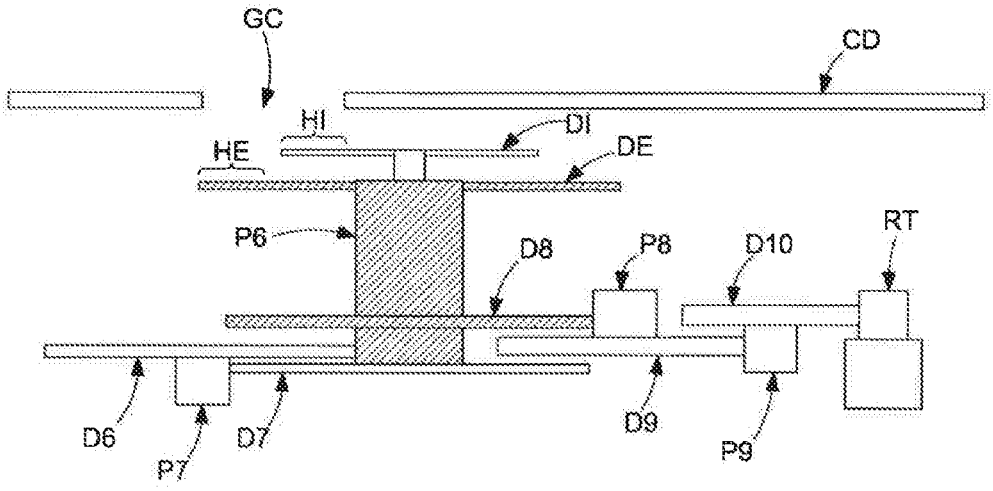
FIG. 3 is a side view of the device for selection of a combination of motifs according to the second aspect of the invention.

According to an alternative embodiment represented in FIG. 3, and corresponding to a second aspect of the invention, the means for actuation drive the outer disc DE instead of driving the inner disc DI. The means for actuation of the inner disc DE then comprise for example a rod which can be actuated (not represented), a disc D6 which can be driven by the rod, and a pinion P6 which engages with the disc D6, and is integral in rotation with the outer disc DE.

In the case when the means for actuation drive the outer disc DE, it is necessary to establish a multiplication ratio M between the outer (drive) disc DE and the inner (driven) disc DI. The gear means comprise for example the pinion P6, the disc D6, a pinion P7 which is integral in rotation with the disc D6, and a disc D7 which engages with the pinion P7, and is integral in rotation with the inner disc DI.

In addition, the outer disc DE of the selection device is connected via a chain comprising discs and pinions to the rotor RT. The chain comprises for example the pinion P6, a disc D8 which is integral in rotation with the pinion P6, a pinion P8 which engages with the disc D8, a disc D9 which is integral in rotation with the pinion P8, a pinion P9 which engages with the disc D9, and a disc D10 which is integral in rotation with the pinion P9.

However, apart from these differences, the operating principle remains unchanged in comparison with the first aspect of the invention.

The invention also relates to a timepiece, not represented in the figures, which comprises a device for selection of motifs as previously described, and can operate according to the first aspect or the second aspect of the invention. In particular, the timepiece can be a payment watch wherein the selection device makes it possible to select means for payment. The motifs are for example, motifs of the bank card type (Visa, MasterCard or the like), borne for example by the inner disc, and bank account motifs, of the purchase or currency type, from which the payment is made, borne for example by the outer disc. Thus, the wearer of the watch selects the card and the account or the currency with which he wants to pay, by putting the corresponding motifs of each disc into correspondence in the aperture of the dial.

The selection device is for example connected to a payment system integrated in the payment watch, the system not being represented in the drawings. Thus, the wearer of the watch selects motifs by means of the selection device, and actuates the payment via the integrated payment system, which transmits bank data, for example to a bank payment terminal.

According to a first particular embodiment, the selection device comprises encoding means arranged below the inner and outer discs in order to transmit the selection information to the payment system. The encoding means are for example optical or capacitive means configured to determine the position of the discs, and thus the motifs selected by the user.

According to a second particular embodiment, the selection device comprises a processing unit, which for example is provided with software configured to count the rotation commands transmitted to the selection device when the user actuates the selection device. Thus, the processing unit can deduce the positions of the discs, and thus the motifs selected by the user.

It will be appreciated that the present invention is not limited to the example illustrated, but can be subjected to different variants and modifications which will become apparent to persons skilled in the art. In particular, the selection device can be used in other fields, the payment watch being only one possible example of use.

The invention claimed is:

1. A device for a timepiece, comprising:

a first disc, known as an inner disc, and a second disc, known as an outer disc, which are coaxial, the inner disc having a smaller diameter than the outer disc, the discs comprising a plurality of angular sectors of a same size, at least two angular sectors of each disc bearing a motif on their periphery;

means for actuation that drive the inner disc, and gear means coupling the two discs such that the outer disc is driven by the inner disc according to a reduction ratio;

a dial extending opposite the inner disc, the dial comprising an aperture making it possible to put one of the motifs of the inner disc and one of the motifs of the outer disc into correspondence, the device being such that a complete rotation of the inner disc gives rise to a rotation of the outer disc by one angular sector, the size of the aperture being sufficiently large for each motif of the outer disc to be in correspondence successively with all the motifs of the inner disc, when the inner disc is rotated.

2. A device for a timepiece, comprising:

a first disc, known as an inner disc, and a second disc, known as an outer disc, which are coaxial, the inner disc having a smaller diameter than the outer disc, the discs comprising a plurality of angular sectors of a same size, at least two angular sectors of each disc bearing a motif on their periphery;

means for actuation that drive the outer disc, and gear means coupling the two discs such that the outer disc drives the inner disc according to a multiplication ratio;

a dial extending opposite the inner disc, the dial comprising an aperture so as to put one of the motifs of the inner disc and one of the motifs of the outer disc into correspondence, wherein a rotation of the outer disc by one angular sector gives rise to a complete rotation of the inner disc, the size of the aperture being sufficiently large for each motif of the outer disc to be in correspondence successively with all the motifs of the inner disc, when the outer disc is rotated.

3. The device according to claim 1, wherein each angular sector of the outer disc bearing one of the motifs is preceded and followed by an angular sector bearing a space without any of the motifs.

4. The device according to claim 1, wherein the inner disc bears at the most four motifs, and advantageously two or three.

5. The device according to claim 1, wherein at least one angular sector of the inner disc bears a space without any of the motifs.

6. The device according to claim 1, wherein the motifs of the inner disc are disposed on consecutive angular sectors, a first motif and a final motif of the motifs of the inner disc being separated by at least one angular sector bearing a space without any of the motifs.

7. The device according to claim 1, comprising a single motor in order to actuate the inner and outer discs together via the gear means and the means for actuation.

8. A timepiece comprising:

a first disc, known as an inner disc, and a second disc, known as an outer disc, which are coaxial, the inner disc having a smaller diameter than the outer disc, the discs comprising a plurality of angular sectors of a same size, at least two angular sectors of each disc bearing a motif on their periphery;

means for actuation that drive the inner disc, and gear means coupling the two discs such that the outer disc is driven by the inner disc according to a reduction ratio;

a dial extending opposite the inner disc, the dial comprising an aperture making it possible to put one of the motifs of the inner disc and one of the motifs of the outer disc into correspondence, the device being such that a complete rotation of the inner disc gives rise to a rotation of the outer disc by one angular sector, the size of the aperture being sufficiently large for each motif of the outer disc to be in correspondence successively with all the motifs of the inner disc, when the inner disc is rotated, wherein the timepiece does not include a display screen.

9. The device according to claim 1, wherein the means for actuation include a first rod, a third disc to be driven by the first rod, and a first pinion that engages with the third disc and is integral in rotation with the inner disc.

10. The device according to claim 9, wherein the gear means include the first pinion, the third disc, a second pinion that is integral in rotation with the first disc, and a fourth disc that engages with the second pinion and is integral in rotation with the outer disc.

11. The device according to claim 2, wherein the means for actuation include a second rod, a fifth disc to be driven by the second rod, and a third pinion that engages with the fifth disc and is integral in rotation with the outer disc.

12. The device according to claim 11, wherein the gear means include the third pinion, the fifth disc, a fourth pinion that is integral in rotation with the third disc, and a sixth disc that engages with the fourth pinion and is integral in rotation with the inner disc.

* * * * *